US007213578B2

(12) United States Patent
Oguma

(10) Patent No.: US 7,213,578 B2
(45) Date of Patent: May 8, 2007

(54) STRUCTURE AND FIXING MEMBER FOR MOUNTING FUEL INJECTION VALVE

(75) Inventor: Yoshitomo Oguma, Hekinan (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 217 days.

(21) Appl. No.: 11/087,803

(22) Filed: Mar. 24, 2005

(65) Prior Publication Data

US 2005/0211225 A1 Sep. 29, 2005

(30) Foreign Application Priority Data

Mar. 29, 2004 (JP) ..... 2004-094998

(51) Int. Cl.
*F02M 61/14* (2006.01)

(52) U.S. Cl. ..... 123/470

(58) Field of Classification Search ..... 123/470, 123/456, 468, 469

See application file for complete search history.

(56) References Cited

U.S. PATENT DOCUMENTS 5,960,774 A * 10/1999 Norgauer et al. ..... 123/470
6,148,797 A * 11/2000 Gmelin ..... 123/456
6,318,341 B1 * 11/2001 Gmelin et al. ..... 123/470
6,334,433 B1 * 1/2002 Sumida et al. ..... 123/470
6,338,333 B1 * 1/2002 Brosseau et al. ..... 123/456
7,104,257 B2 * 9/2006 Kawamoto et al. ..... 123/470
2004/0194764 A1 * 10/2004 Okajima et al. ..... 123/469

FOREIGN PATENT DOCUMENTS

JP 9-88765 9/1995

* cited by examiner

*Primary Examiner*—Stephen K. Cronin
*Assistant Examiner*—Arnold Castro
(74) *Attorney, Agent, or Firm*—Nixon & Vanderhye P.C.

(57) ABSTRACT

In a mounting structure for mounting an injector to an internal combustion engine, a fixing member is inserted into a hole of a cylinder head in an axial direction. Thus, the injector is fixed between the fixing member and the cylinder head. A connector portion of the fixing member is inserted into the hole of the cylinder head together with the fixing member. Therefore, the connector portion of the fixing member can be easily connected with a connector portion of the injector even if the hole of the cylinder head is deep. A first socket provided on an end of the connector portion of the fixing member opposite from the injector is disposed outside the cylinder head. Therefore, the injector can be easily connected with a power source.

18 Claims, 8 Drawing Sheets

STRUCTURE AND FIXING MEMBER FOR MOUNTING FUEL INJECTION VALVE

CROSS REFERENCE TO RELATED APPLICATION

This application is based on and incorporates herein by reference Japanese Patent Application No. 2004-94998 filed on Mar. 29, 2004.

BACKGROUND OF THE INVENTION

1. Field of the Invention

The present invention relates to a mounting structure and a fixing member for mounting a fuel injection valve to an internal combustion engine.

2. Description of Related Art

A technology disclosed in JP-A-H09-88765 (Patent Document 1) is publicly known as a mounting structure of a fuel injection valve in an engine, for instance. In the technology of Patent Document 1, a fixing member is attached to an end of the fuel injection valve on a side opposite from a combustion chamber so that the fuel injection valve is held between the fixing member and a cylinder head. In this case, in order to respond to a pressure in the combustion chamber, the fixing member is formed by a member having relatively high rigidity and is fixed to the cylinder head with a screw member.

In the case of a direct injection type engine, which injects fuel directly into a combustion chamber of the engine, the fuel injection valve should be preferably disposed in a central part of the combustion chamber in order to improve engine efficiency. However, in the case where the fuel injection valve is disposed in the central part of the combustion chamber, the fuel injection valve needs to be inserted deeply into the cylinder head so that the fuel injection valve penetrates the cylinder head. Moreover, recently, equipments are densely arranged around the engine. Therefore, in the case where the fixing member, of which a flange extends from the hole of the cylinder head, and the screw member for fixing the fixing member to the cylinder head are used as in the technology of Patent Document 1, it is difficult to ensure spaces for installing the fixing member and the screw member.

The fuel injection valve is operated by electric power supplied to an electromagnetic drive portion. Therefore, the fuel injection valve has a connector, which is connected with a power source. However, in the case where the fuel injection valve is inserted deeply into the cylinder head, it is difficult to connect the connector with the power source, and it is difficult to ensure an accommodation portion for accommodating the connector.

SUMMARY OF THE INVENTION

It is therefore an object of the present invention to provide a mounting structure of a fuel injection valve capable of facilitating fixation of the fuel injection valve and connection between the fuel injection valve and a power source and of reducing a volume necessary for installing the fuel injection valve even in the case where the fuel injection valve is inserted deeply into a cylinder head.

It is another object of the present invention to provide a fixing member capable of facilitating fixation of a fuel injection valve and connection between the fuel injection valve and a power source and of reducing a volume necessary for installing the fuel injection valve even in the case where the fuel injection valve is inserted deeply into a cylinder head.

According to an aspect of the present invention, a fuel injection valve is pressed in an axial direction between a fixing member and a cylinder head. Therefore, in the case where the fuel injection valve is inserted deeply into the cylinder head, the fuel injection valve is pressed against the cylinder head through the fixing member. Accordingly, the fuel injection valve can be fixed easily. A first connector of the fuel injection valve is electrically connected with a second connector disposed radially outside the fixing member. Therefore, the first connector of the fuel injection valve, which is inserted into a deep hole, is connected with the second connector, which is inserted into the hole together with the fixing member. An end of the second connector opposite from the first connector is disposed outside the hole of the cylinder head. Therefore, the fuel injection valve can be easily connected with a power source even in the case where the fuel injection valve is inserted deeply into the cylinder head. Moreover, the first connector is connected with the power source through the second connector. Therefore, the first connector can be formed in a simple shape. As a result, a volume necessary for installing the fuel injection valve having the first connector can be reduced.

According to another aspect of the present invention, a fixing member presses a fuel injection valve in an axial direction between the fixing member and a cylinder head. Therefore, the fuel injection valve is pressed against the cylinder head through the fixing member in the case where the fuel injection valve is inserted deeply into the cylinder head. Thus, the fuel injection valve can be fixed easily. A first connector of the fuel injection valve is electrically connected with a second connector disposed radially outside the fixing member. Therefore, the first connector of the fuel injection valve, which is inserted into a deep hole, is connected with the second connector, which is inserted into the hole together with the fixing member. An end of the second connector opposite from the first connector is disposed outside the hole of the cylinder head. Therefore, the fuel injection valve can be easily connected with a power source even in the case where the fuel injection valve is inserted deeply into the cylinder head. Moreover, the first connector is connected with the power source through the second connector. Therefore, the first connector can be formed in a simple shape. As a result, a volume necessary for installing the fuel injection valve having the first connector can be reduced.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 1:
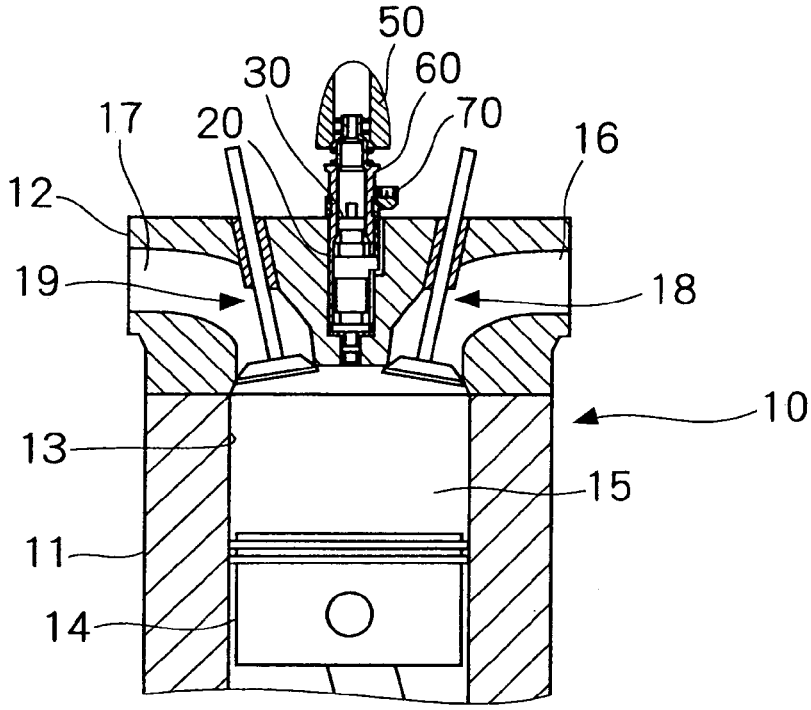
FIG. 1 is a sectional view showing a mounting structure of an injector according to a first embodiment of the present invention.

Referring to FIG. 1, a mounting structure of a fuel injection valve according to a first embodiment of the present invention applied to an internal combustion engine (a direct injection type gasoline engine) 10 is illustrated.

As shown in FIG. 1, the engine 10 includes a cylinder block 11 and a cylinder head 12. The cylinder block 11 provides a cylinder 13. The cylinder block 11 and the cylinder head 12 are formed by casting the iron, the aluminum alloy and the like. The cylinder 13 holds a piston 14 so that the piston 14 can reciprocate. An inner wall of the cylinder block 11 providing the cylinder 13, an end surface of the piston 14 on a cylinder head 12 side and an end surface of the cylinder head 12 on a piston 14 side define a combustion chamber 15.

The cylinder head 12 is formed with an intake passage 16 and an exhaust passage 17. The intake passage 16 and the exhaust passage 17 can communicate with the combustion chamber 15 respectively. An end of the intake passage 16 on a combustion chamber 15 side is opened or closed by an intake valve 18. An end of the exhaust passage 17 on a combustion chamber 15 side is opened or closed by an exhaust valve 19.

Figure 2:
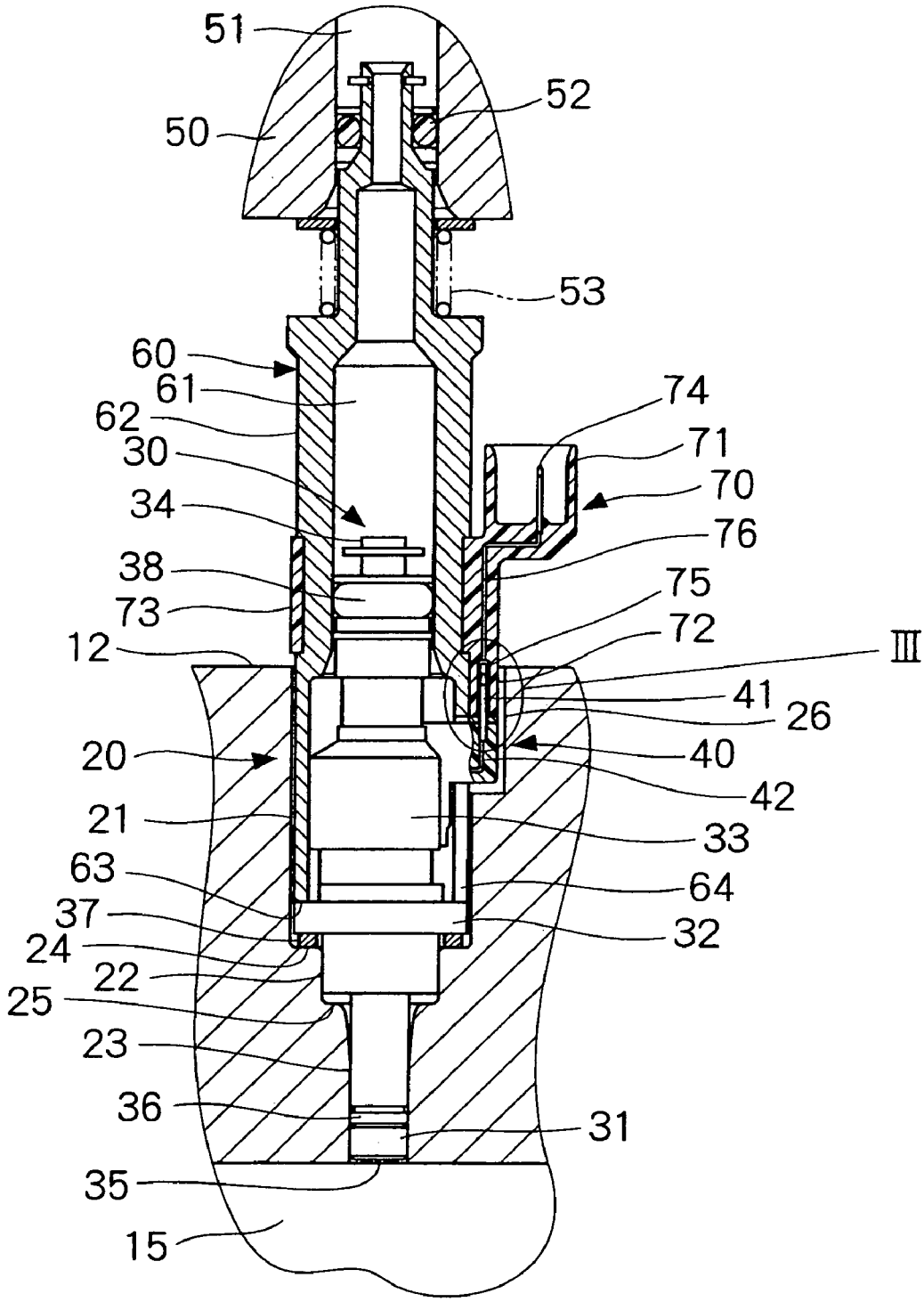
FIG. 2 is a sectional view showing a substantial portion of the mounting structure of the injector according to the first embodiment.

The cylinder head 12 is formed with a hole 20 between the intake valve 18 and the exhaust valve 19. The hole 20 penetrates the cylinder head 12 in a thickness direction of the cylinder head 12. The engine. 10 has a fuel injection valve (an injector) 30, which is accommodated in the hole 20. As shown in FIG. 2, the hole 20 provided by the cylinder head 12 includes a large diameter portion 21, an intermediate diameter portion 22 and a small diameter portion 23, of which internal diameters are different from each other. The small diameter portion 23, the intermediate diameter portion 22 and the large diameter portion 21 are arranged in that order in an axial direction from the combustion chamber 15 side. The internal diameter of the intermediate diameter portion 22 is larger than that of the small diameter portion 23 and is smaller than that of the large diameter portion 21. Thus, a stepped portion 24 is provided between the large diameter portion 21 and the intermediate diameter portion 22, and a stepped portion 25 is provided between the intermediate diameter portion 22 and the small diameter portion 23. The hole 20 is formed with an enlarged portion 26, which enlarges radially outward, in a part of the large diameter portion 21.

As shown in FIG. 2, the injector 30 includes a nozzle 31, a flange 32, an electromagnetic drive portion 33, a supply portion 34, a connector portion 40 as a first connector, and the like. An injection hole 35 is formed in an end of the nozzle 31 on the combustion chamber 15 side. The nozzle 31 is inserted into the small diameter portion 23 of the hole 20. A sealing member 36 is interposed between the inner wall of the cylinder head 12, which provides the hole 20, and the nozzle 31. The sealing member 36 is made of a heat-resistant resin such as a resin containing fluorine. The sealing member 36 prevents leak of a gas mixture or a combustion gas from the combustion chamber 15 to the outside of the cylinder head 12. The flange 32 strikes the stepped portion 24 across a sealing member 37. Thus, an axial position of the injector 30 is determined. The sealing member 37 and the sealing member 36 prevent the leak of the gas mixture or the combustion gas from the combustion chamber 15 to the outside of the cylinder head 12.

A valve member such as a needle driven by the electromagnetic drive portion 33 is accommodated in the injector 30. The valve member reciprocates in the axial direction of the injector 30. The electromagnetic drive portion 33 includes a coil for generating an electromagnetic attraction for driving the valve member, and the like. Energization of the coil is turned on and off to reciprocate the valve member in the axial direction of the injector 30. Thus, the injection hole 35 is opened and closed.

Figure 3:
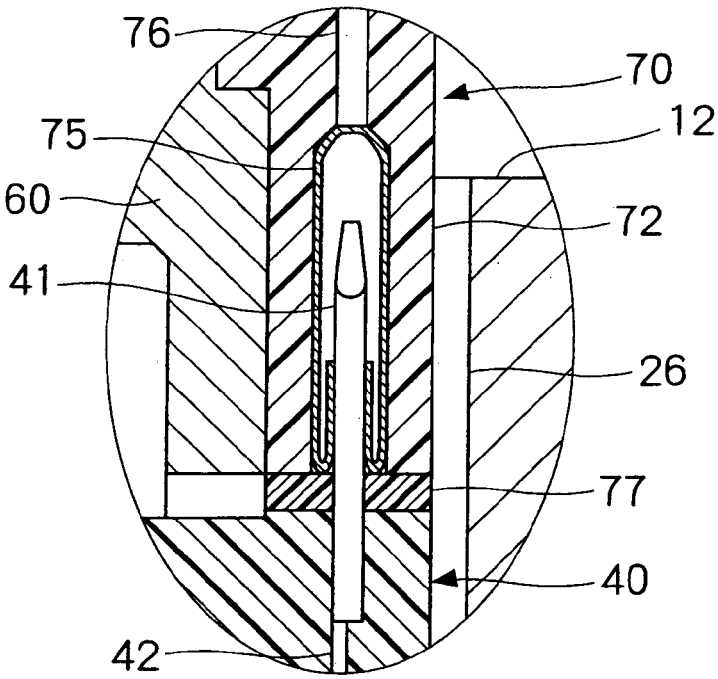
FIG. 3 is an enlarged sectional view showing a substantial portion of the mounting structure of the injector of FIG. 2.

The connector portion 40 is provided so that the connector portion 40 protrudes radially outward from the electromagnetic drive portion 33. The connector portion 40 includes a terminal 41 and a wiring member 42 as shown in FIG. 3. The wiring member 42 electrically connects the terminal 41 with the coil of the electromagnetic drive portion 33. The connector portion 40 is formed by a resin integrally with the injector 30 while the terminal 41 and the wiring member 42 are inserted into the connector portion 40. The connector portion 40 is accommodated in the enlarged portion 26 of the cylinder head 12.

As shown in FIG. 2, the supply portion 34 is disposed on a side of the electromagnetic drive portion 33 opposite from the injection hole 35. The fuel is supplied to the injector 30 from a fuel tank through a pipe member 50 of a fuel supply section and a fixing member 60. The fuel supplied through the pipe member 50 and the fixing member 60 flows into the supply portion 34 of the injector 30. The fuel flowing into the supply portion 34 flows through an inside of the injector 30 and is injected into the combustion chamber 15 through the injection hole 35. The pipe member 50 is formed in a cylindrical shape and is formed with a fuel passage 51 inside.

The fixing member 60 is disposed substantially coaxially with the hole 20, the injector 30 and the pipe member 50. The fixing member 60 holds the injector 30 between the pipe member 50 and the cylinder head 12. The fixing member 60 has a cylinder portion 62 providing a fuel passage 61 inside. The cylinder portion 62 accommodates a part of the injector 30. A part of the fixing member 60 with respect to the axial direction is accommodated in the hole 20 of the cylinder head 12. An end of the fixing member 60 on the combustion chamber 15 side with respect to the axial direction provides a contacting portion 63. The contacting portion 63 contacts the flange 32 of the injector 30. The other end of the fixing member 60 opposite from the contacting portion 63 is inserted into an inner peripheral side of the pipe member 50. The pipe member 50 is disposed on a side of the cylinder head 12 opposite from the cylinder block 11. Therefore, the fixing member 60 is held between the pipe member 50 and the cylinder head 12 by interposing the fixing member 60 between the pipe member 50 and the cylinder head 12. At that time, a load pressing the fixing member 60 against the cylinder head 12 is applied to the fixing member 60. As a result, the injector 30 is held between the fixing member 60 and the cylinder head 12 and pressed against the cylinder head 12.

Figure 4:
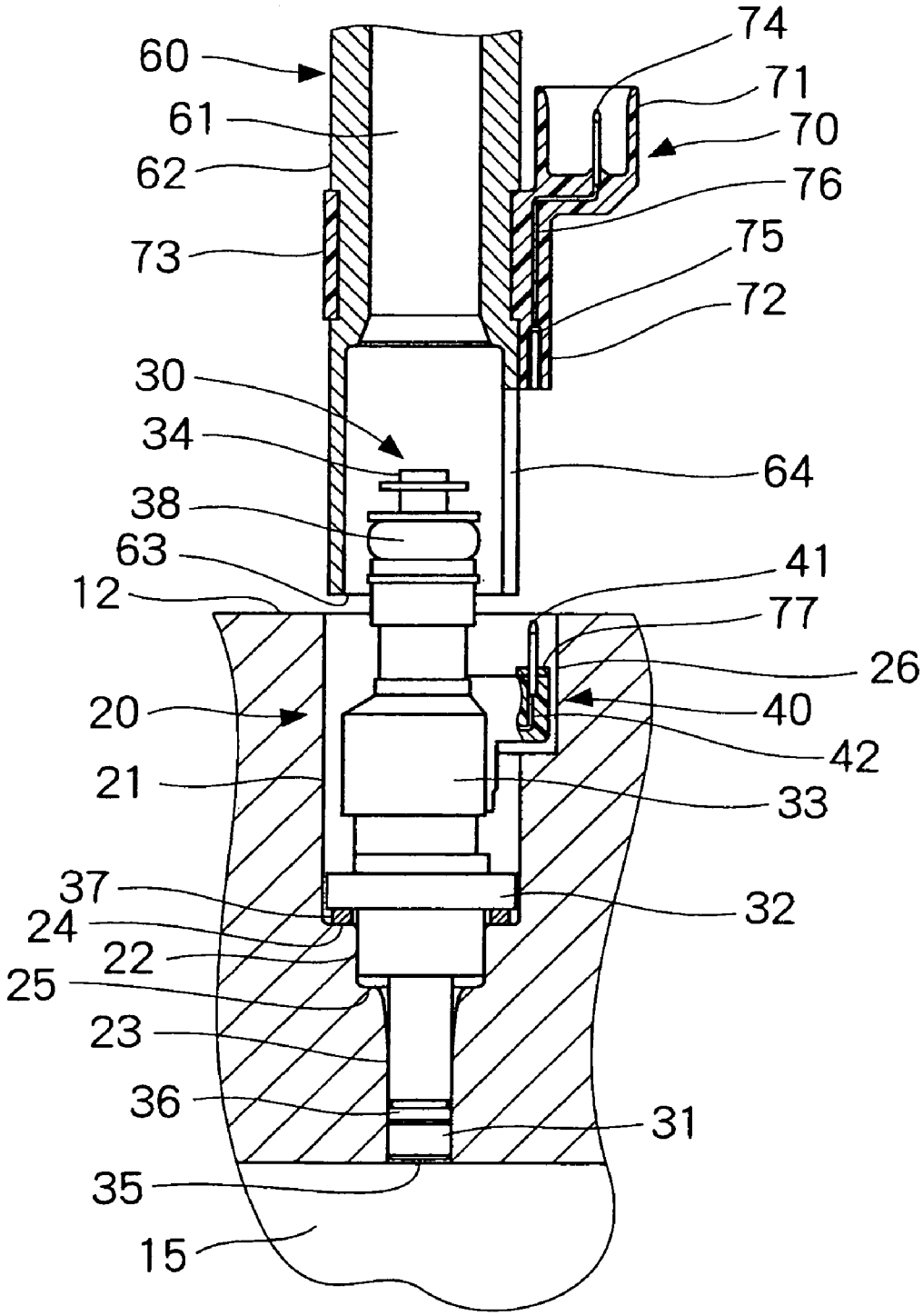
FIG. 4 is a sectional view showing the mounting structure of the injector according to the first embodiment at a time when the injector is mounted.

The supply portion 34 of the injector 30 is positioned in an intermediate portion of the fixing member 60 with respect to the axial direction. A sealing member 38 seals a space between the injector 30 and the fixing member 60. The fixing member 60 is formed with an opening portion 64 in the cylinder portion 62 as shown in FIGS. 2 and 4. The connector portion 40 of the injector 30 radially penetrates the opening portion 64. Thus, the connector portion 40 protruding from the injector 30 is inserted into the opening portion 64 when the fixing member 60 is mounted from a side of the injector 30 opposite from the cylinder head 12. Thus, interference between the injector 30 and the fixing member 60 can be prevented when the fixing member 60 is mounted. The opening portion 64 is formed at a position between the combustion chamber 15 and a position where the sealing member 38 of the injector 30 contacts the inner wall of the fixing member 60. Thus, the fuel flowing through the fuel passage 61 can be prevented from flowing out along the outer wall of the injector 30.

The fixing member 60 has a connector portion 70 as a second connector connected with the connector portion 40 of the injector 30 as shown in FIG. 2. The connector portion 70 includes a first socket 71, a second socket 72 and a body portion 73. The first socket 71 is provided with a terminal 74 as a first terminal connected with a wiring portion, which supplies electric power from the power source. The first socket 71 is disposed outside the cylinder head 12. More specifically, the first socket 71 is exposed to the outside of the cylinder head 12.

The second socket 72 is provided with a socket terminal 75 as a second terminal electrically connected with the terminal 41 of the injector 30. The terminal 74 and the socket terminal 75 are respectively made of an electrically conductive material. The terminal 74 and the socket terminal 75 are electrically connected with each other by a wiring member 76. The socket terminal 75 is formed substantially in the shape of a cup as shown in FIG. 3. The socket terminal 75 is fitted with the terminal 41 by inserting the terminal 41 of the injector 30 into the socket terminal 75. The terminal 74 connected with the power source is electrically connected with the coil of the electromagnetic drive portion 33 by connecting the connector portion 70 of the fixing member 60 to the connector portion 40 of the injector 30. A sealing member 77 is disposed between the connector portion 70 of the fixing member 60 and the connector portion 40 of the injector 30. The sealing member 77 prevents intrusion of water or oil into the connector portion 40 or the connector portion 70.

Figure 5A:
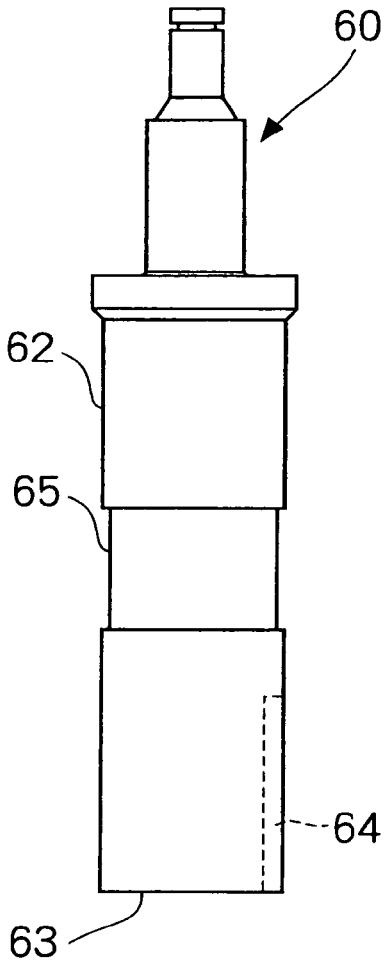
FIG. 5A is a view showing a fixing member used in the mounting structure of the injector according to the first embodiment.
Figure 5B:
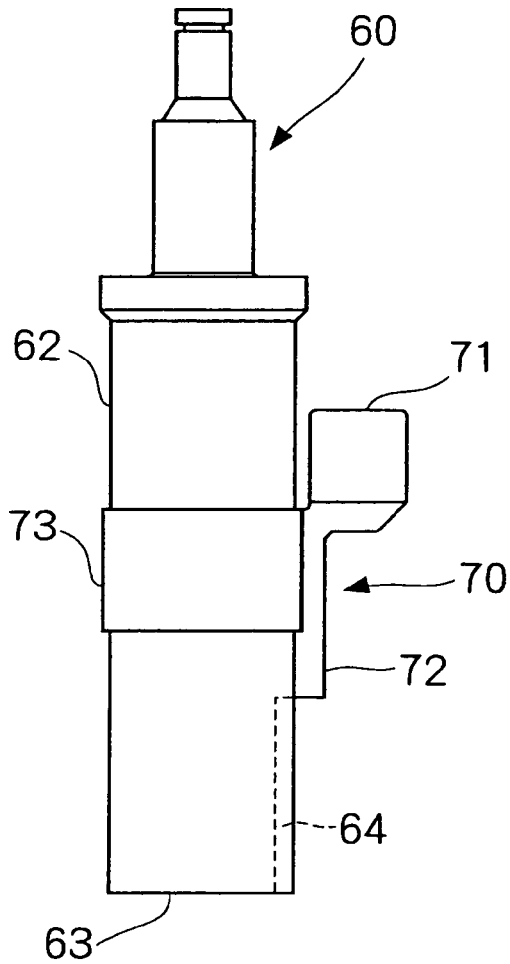
FIG. 5B is a view showing the fixing member used in the mounting structure of the injector according to the first embodiment.

The body portion 73 as a resin molding circumferentially surrounds the periphery of the fixing member 60 and is fixed to the fixing member 60. The terminal 74 of the first socket 71, the socket terminal 75 of the second socket 72 and the wiring member 76 are inserted into the resin forming the body portion 73. The fixing member 60 is formed with a small diameter portion 65, of which an outer diameter is reduced, as shown in FIG. 5A. The connector portion 70 is formed as the resin molding integrated with the fixing member 60 by forming the body portion 73 around the periphery of the small diameter portion 65 so that the fixing member 60 is inserted as shown in FIG. 5B.

As shown in FIG. 2, the pipe member 50 provides the fuel passage 51 inside. The end of the fixing member 60 opposite from the combustion chamber 15 is inserted into the pipe member 50. A sealing member 52 for sealing the flow of the fuel is interposed between the fixing member 60 and the pipe member 50. The sealing member 52 prevents the fuel supplied from the pipe member 50 from flowing toward the combustion chamber 15 along the outer wall of the fixing member 60. Thus, the fuel supplied from the pipe member 50 flows to the supply portion 34 of the injector 30 along the inner peripheral side of the fixing member 60.

A spring 53 as a resilient member is interposed between the end of the pipe member 50 on the combustion chamber 15 side and the fixing member 60. The spring 53 can extend and contract in the axial direction. When the pipe member 50 and the fixing member 60 make relative movement in the axial direction, the spring 53 absorbs the movement. The spring 53 also absorbs a dimensional tolerance of the fixing member 60 or a tolerance of a distance between the pipe member 50 and the cylinder head 12. Instead of the spring 53 as the resilient member, an elastic member made of a resin such as rubber may be employed. A structure for applying a force to the spring 53 for extending in the axial direction so that the spring 53 presses the fixing member 60 against the cylinder head 12 may be employed.

Next, a method of mounting the injector 30 to the cylinder head 12 will be explained.

The injector 30 is inserted into the hole 20 when the injector 30 is mounted to the cylinder head 12. Since the sealing member 36 is fitted to the nozzle 31 of the injector 30, the nozzle 31 is press-fitted into the small diameter portion 23. The sealing member 37 is placed on the stepped portion 24 before the injector 30 is inserted. The injector 30 is inserted until the flange 32 contacts the sealing member 37 placed on the stepped portion 24. The axial movement of the injector 30 is limited and the axial position of the injector 30 is determined because the flange 32 contacts the sealing member 37 placed on the stepped portion 24.

The fixing member 60 is placed around the outer periphery of the injector 30 after the injector 30 is inserted into the hole 20. The cylinder portion 62 of the fixing member 60 is interposed between the outer wall of the injector 30 and the inner wall of the cylinder head 12, which provides the hole 20. The internal diameter of the fixing member 60 is slightly larger than the external diameter of the injector 30. The connector portion 40 protruding from the injector 30 is inserted through the opening portion 64 of the fixing member 60. Therefore, the fixing member 60 can be easily placed around the outer periphery of the injector 30 as shown in FIG. 4. At that time, the fixing member 60 is inserted until the contacting portion 63 as the end of the fixing member 60 on the combustion chamber 15 side contacts the flange 32 of the injector 30.

The connector portion 40 of the injector 30 is connected to the connector portion 70 of the fixing member 60 when the fixing member 60 is mounted. As shown in FIG. 3, the terminal 41 protruding from the connector portion 40 to the side opposite from the combustion chamber 15 is inserted into the socket terminal 75 of the connector portion 70. More specifically, by moving the fixing member 60 in the axial direction, the terminal 41 and the socket terminal 75 are fitted and electrically connected with each other. Thus, the first socket 71 of the fixing member 60 disposed outside the cylinder head 12 is electrically connected with the coil of the injector 30.

The end of the fixing member 60 on the side opposite from the combustion chamber 15 is connected with the pipe member 50 after the fixing member 60 is mounted as shown in FIG. 2. At that time, the spring 53 is interposed between the pipe member 50 and the fixing member 60. The fixing member 60 is held between the pipe member 50 and the cylinder head 12 by connecting the fixing member 60 with the pipe member 50. Thus, the axial movement of the fixing member 60 is limited. At that time, a load applied from the pipe member 50 to the fixing member 60 presses the injector 30, which contacts the contacting portion 63 of the fixing member 60, against the cylinder head 12. Thus, the injector 30 is fixed between the fixing member 60 and the cylinder head 12.

By regulating the load caused between the pipe member 50 and the fixing member 60, the force pressing the injector 30 against the cylinder head 12 can be regulated. The force of the pipe member 50 for pressing the injector 30 can counter a force applied to the injector 30 by a pressure of the combustion gas in the combustion chamber 15. A structure for pressing the injector 30 against the cylinder head 12 with the use of a pressing force of the spring 53 may be employed.

A wiring portion extending from the power source is connected to the first socket 71 after the fixing member 60 is interposed between the pipe member 50 and the cylinder head 12. Thus, the power source is electrically connected with the coil of the injector 30.

As explained above, in the first embodiment, the injector 30 is fixed between the fixing member 60 and the cylinder head 12 by inserting the fixing member 60 into the hole 20 of the cylinder head 12 in the axial direction. The fixing member 60 is held between the pipe member 50, which supplies the fuel, and the cylinder head 12. Accordingly, the injector 30 is held and fixed between the fixing member 60 and the cylinder head 12. Therefore, the injector 30 can be easily fixed to the cylinder head 12 by regulating total length of the fixing member 60 in the axial direction even in the case where the hole 20 of the cylinder head 12 is deep.

In the first embodiment, the connector portion 40 of the injector 30 is connected with the connector portion 70 of the fixing member 60 by moving the fixing member 60 in the axial direction. The connector portion 70 of the fixing member 60 is inserted into the hole 20 of the cylinder head 12 together with the fixing member 60. Therefore, the connector portion 70 of the fixing member 60 can be easily connected to the connector portion 40 of the injector 30 even in the case where the hole 20 of the cylinder head 12 is deep. The first socket 71 of the connector portion 70 on the side opposite from the injector 30 is disposed outside the cylinder head 12. Therefore, the injector 30 can be easily connected with the power source even in the case where the injector 30 is inserted deeply into the hole 20 of the cylinder head 12.

The connector portion 40 of the injector 30 and the connector portion 70 of the fixing member 60 are connected with each other by fitting the connector portion 40 with the connector portion 70 in the axial direction. Therefore, protrusion of the connector portion 40 and the connector portion 70 in the radial direction can be inhibited. Thus, there is no need to form a large-diameter hole in the cylinder head 12. As a result, the volume necessary for installing the injector 30 can be reduced.

The terminal 74 and the socket terminal 75 of the connector portion 70 are disposed separately from each other in the axial direction. Accordingly, the connector portion 70 extends in the axial direction. Thus, the enlargement of the connector portion 70 in the radial direction can be inhibited. Therefore, the connector portion 70 and the connector portion 40 connected with the connector portion 70 do not enlarge in the radial direction. As a result, a volume for installing the connector portion 40 and the connector portion 70 can be reduced.

In the first embodiment, the coil of the injector 30 is connected with the power source through the connector portion 70 of the fixing member 60. Therefore, the connector portion 40 of the injector 30 may be formed in a simple shape. Thus, the shape of the connector portion 40 protruding radially outward from the injector 30 can be simplified and the size of the connector portion 40 can be reduced. As a result, the connector portion 40 of the injector 30 and the second socket 72 of the fixing member 60 connected to the connector portion 40 are easily inserted into the enlarged portion 26, which is slightly enlarged radially outward from the large diameter portion 21. Therefore, the volume necessary for installing the injector 30 formed with the connector portion 40 can be reduced. Since the volume necessary for installing the injector 30 is reduced, the injector 30 can be easily installed even if the equipments are densely arranged around the engine 10 and a sufficient space cannot be ensured around the engine 10.

In the first embodiment, the connector portion 70 of the fixing member 60 is connected with the connector portion 40 of the injector 30 in the axial direction. The fixing member 60 is held between the pipe member 50 and the cylinder head 12. Therefore, the load is continuously applied to the fixing member 60 along the direction toward the cylinder head 12. Accordingly, the connector portion 70 of the fixing member 60 is continuously pressed against the connector portion 40 of the injector 30. As a result, the terminal 41 of the connector portion 40 does not come off the socket terminal 75 of the connector portion 70. Therefore, a structure for preventing the terminal 41 from coming off the socket terminal 75 is unnecessary. As a result, the structure can be simplified.

(Second Embodiment)

Next, a fixing member 60 according to a second embodiment of the present invention for mounting the injector 30 will be explained based on FIGS. 6A and 6B.

Figure 6A:
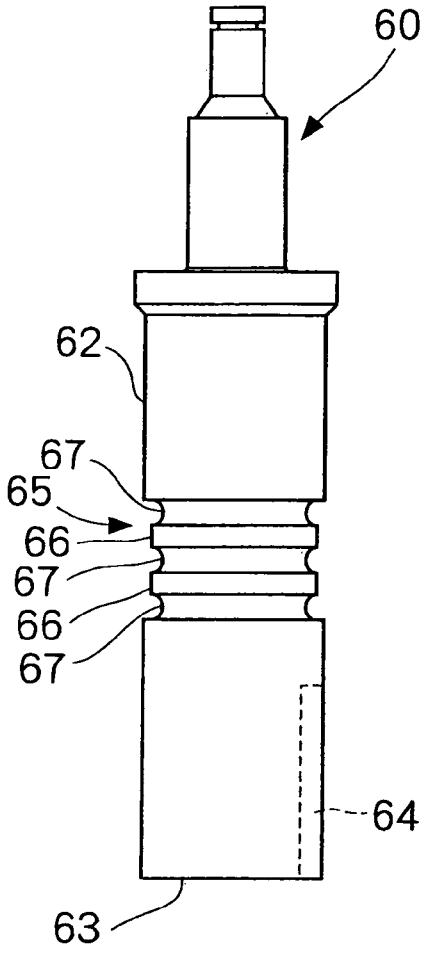
FIG. 6A is a view showing a fixing member used in a mounting structure of an injector according to a second embodiment of the present invention.
Figure 6B:
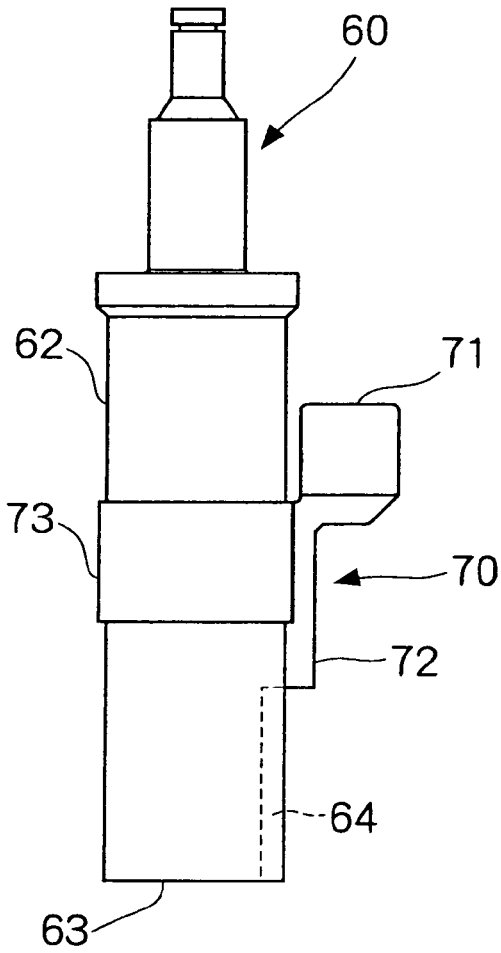
FIG. 6B is a view showing the fixing member used in the mounting structure of the injector according to the second embodiment.

The fixing member 60 of the second embodiment shown in FIG. 6A is formed with ribs 66 and grooves 67 on an outer wall of a small diameter portion 65 of the fixing member 60. Thus, a contacting area between a resin molding, which forms a body portion 73 of a connector portion 70 shown in FIG. 6B, and the small diameter portion 65 of the fixing member 60 is enlarged. Accordingly, connection of the body portion 73 of the connector portion 70 to the small diameter portion 65 can be improved. As a result, the connector portion 70 can be firmly mounted to the fixing member 60.

(Third Embodiment)

Next, a fixing member 60 according to a third embodiment of the present invention will be explained based on FIGS. 7A and 7B.

Figure 7A:
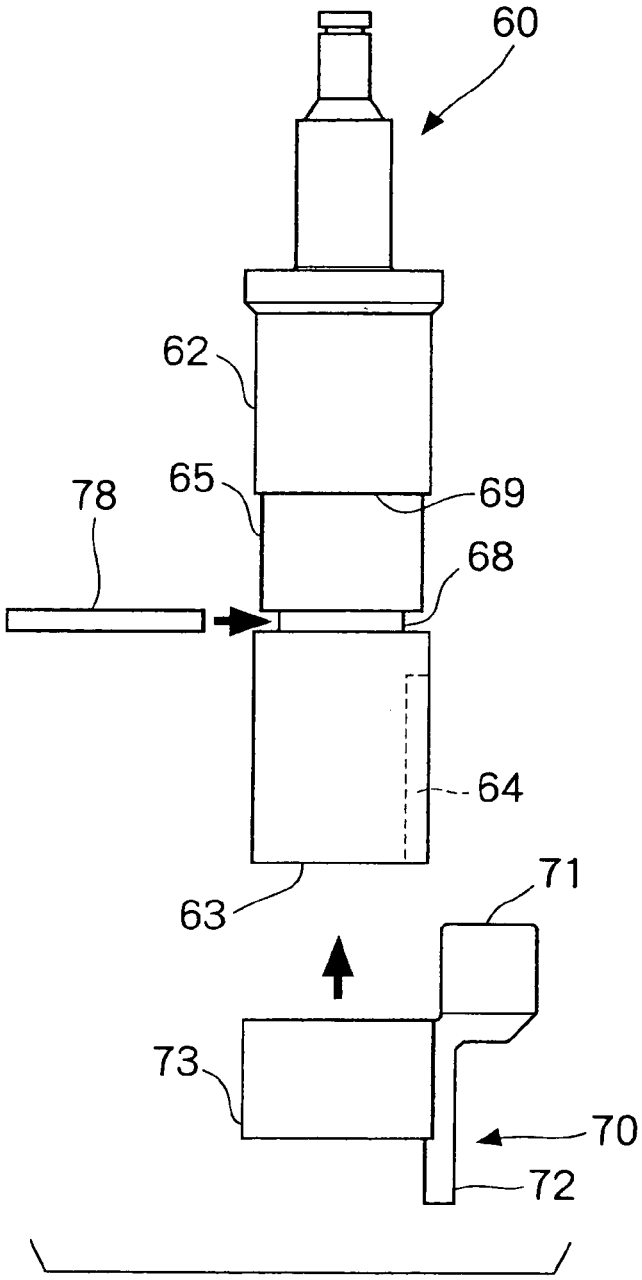
FIG. 7A is a view showing a fixing member used in a mounting structure of an injector according to a third embodiment of the present invention.
Figure 7B:
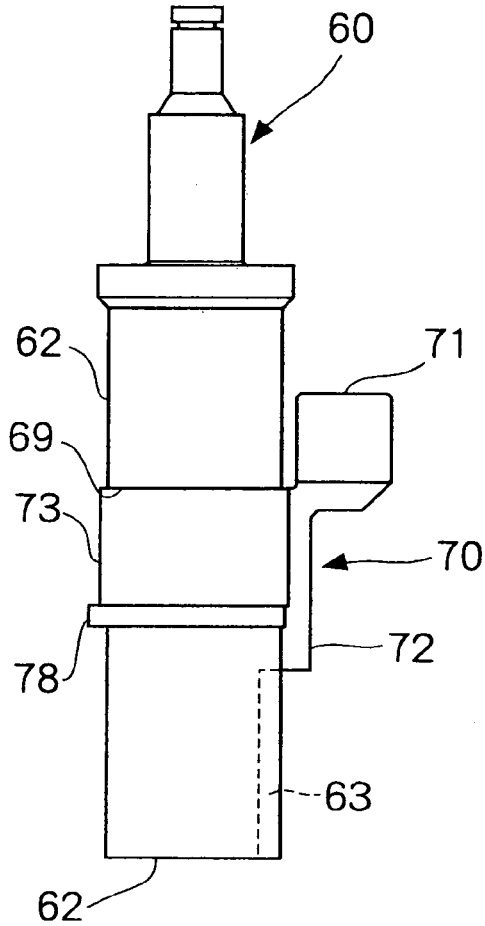
FIG. 7B is a view showing the fixing member used in the mounting structure of the injector according to the third embodiment.

A connector portion 70 of the third embodiment is formed beforehand separately from the fixing member 60 as shown in FIG. 7A. A body portion 73 of the connector portion 70 is formed in a cylindrical shape. A small diameter portion 65 of the fixing member 60 is inserted into the body portion 73 of the connector portion 70. Then, a ring member 78 as a holding member is press-fitted or fitted to a groove 68 formed on the fixing member 60 for preventing the connector portion 70 from coming off the fixing member 60. The groove 68 is formed circumferentially on an outer wall of the fixing member 60 and is caved radially inward. Movement of the connector portion 70 toward the combustion chamber 15 is limited by fitting the ring member 78 to the groove 68. The movement of the connector portion 70 toward the side opposite from the combustion chamber 15 is limited by a step 69 provided between the small diameter portion 65 and a cylinder portion 62 of the fixing member 60, because the connector portion 70 is mounted around the small diameter portion 65 of the fixing member 60. Thus, the fixing member 60 and the connector portion 70, which are formed separately, can be mounted integrally.

(Fourth Embodiment)

Next, a fixing member 60 according to a fourth embodiment of the present invention will be explained based on FIG. 8.

Figure 8:
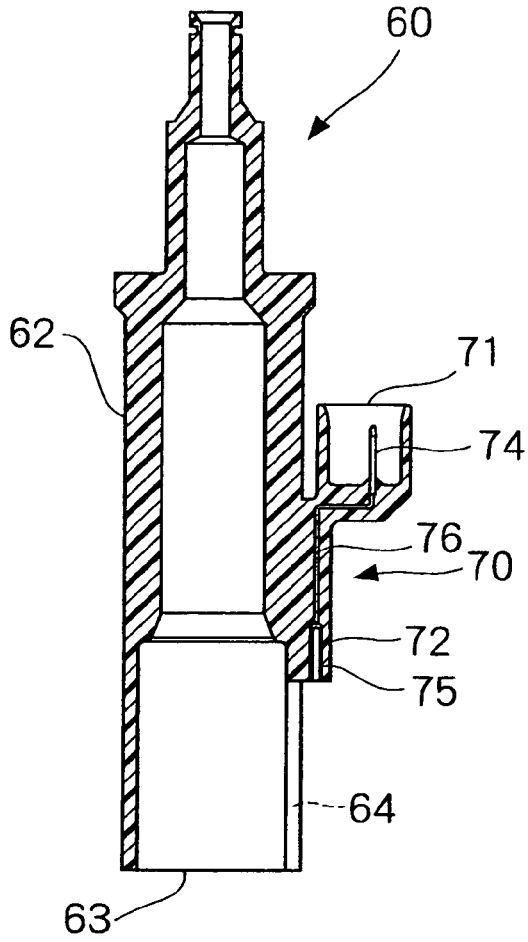
FIG. 8 is a sectional view showing a fixing member used in a mounting structure of an injector according to a fourth embodiment of the present invention.

In the fourth embodiment, the fixing member 60 and a connector portion 70 are formed by a resin in a single piece as shown in FIG. 8. The connector portion 70 and the fixing member 60 are formed by the resin in the single piece while a terminal 74, a socket terminal 75 and a wiring member 76 of the connector portion 70 are inserted into the connector portion 70. Thus, the structure is simplified and the number of parts can be reduced.

(Fifth Embodiment)

Next, a mounting structure and a fixing member for mounting an injector 30 according to a fifth embodiment of the present invention will be explained based on FIG. 9.

Figure 9:
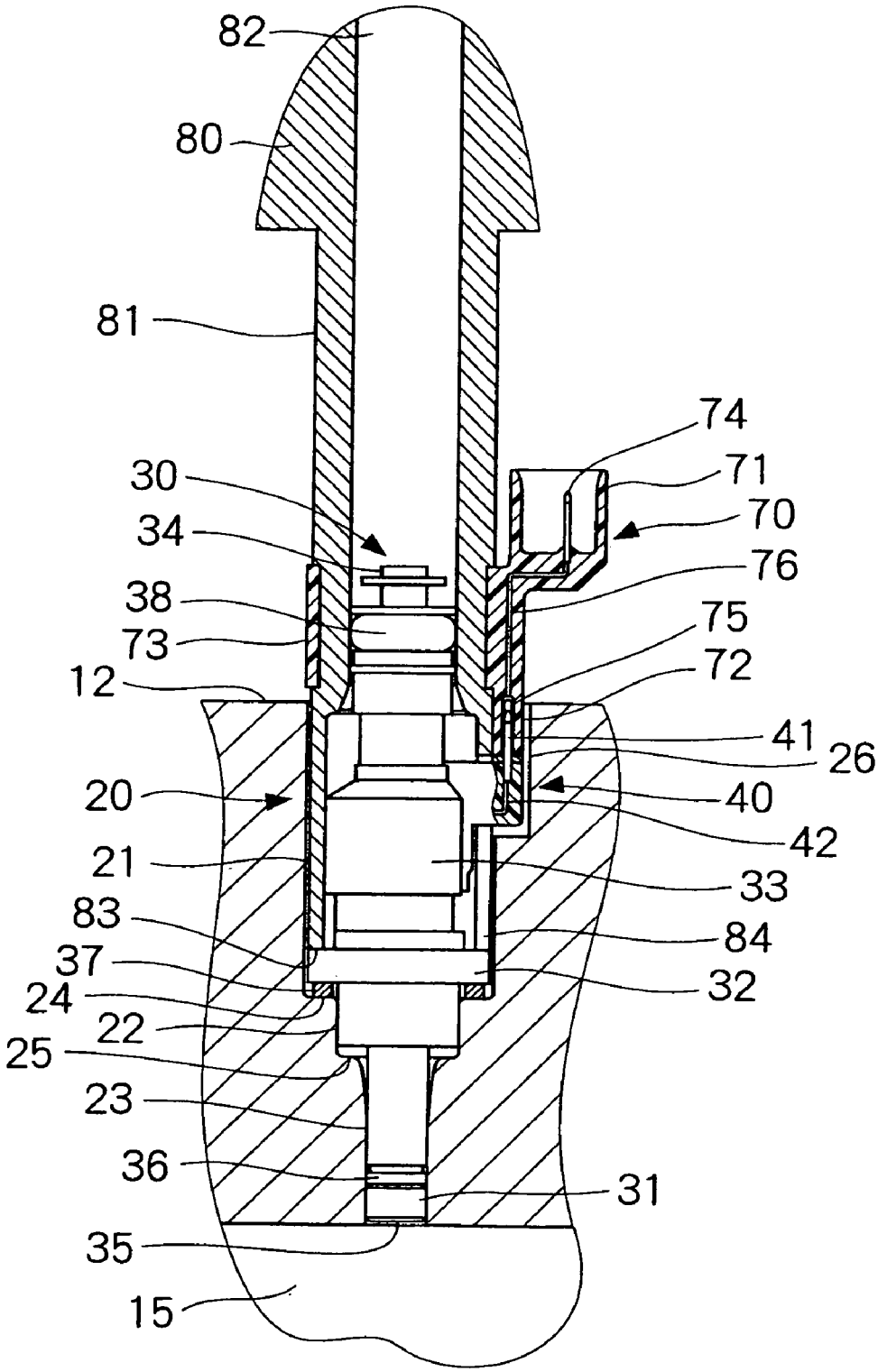
FIG. 9 is a sectional view showing a mounting structure of an injector according to a fifth embodiment of the present invention.

As shown in FIG. 9, a pipe member 80 of the fifth embodiment doubles as a fixing member. More specifically, the pipe member 80 is formed integrally with a cylinder portion 81 as a fixing member, and the cylinder portion 81 axially extends toward the combustion chamber 15. Thus, the pipe member 80 provides a fuel passage 82 inside for supplying the fuel, and an end of the pipe member 80 on the combustion chamber 15 side provides a contacting portion 83, which contacts a flange 32 of the injector 30. The pipe member 80 is formed with an opening portion 84, through which a connector portion 40 of the injector 30 is inserted. The pipe member 80 includes a connector portion 70 connected with a connector portion 40 of the injector 30. The structure of the connector portion 70 is the same as that of the first embodiment.

In the fifth embodiment, the injector 30 is held between the pipe member 80, which is integrated with the cylinder portion 81, and the cylinder head 12. Thus, the injector 30 can be easily mounted and an increase of the number of parts can be inhibited even in the case where the injector 30 is mounted in a deep hole 20 of the cylinder head 12. Meanwhile, the structure can be further simplified.

(Modifications)

Figure 10:
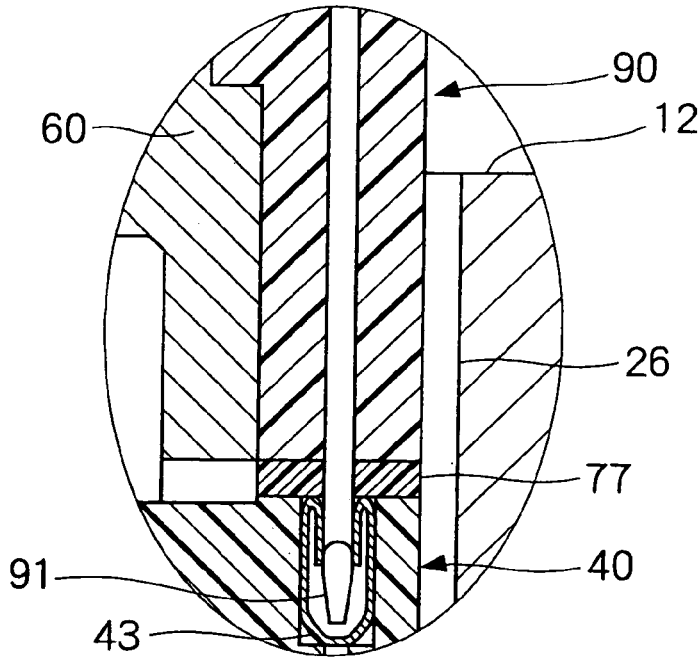
FIG. 10 is a sectional view showing a substantial portion of a mounting structure of an injector of a modified example of the present invention.

In the above embodiments, the terminal 41 protruding from the connector portion 40 of the injector 30 toward the side opposite from the combustion chamber 15 is inserted into the socket terminal 75 disposed in the connector portion 70 of the fixing member 60 or the pipe member 80. Alternatively, a terminal 91 may protrude from a connector portion 90 of the fixing member 60 toward the combustion chamber 15 side and a socket terminal 43 may be formed in the connector portion 40 of the injector 30 as shown in FIG. 10. In this case, the terminal 91 protruding from the fixing member 60 is inserted into the socket terminal 43 of the injector 30 by moving the fixing member 60 in the axial direction.

In the above embodiments, the present invention is applied to the gasoline engine. Alternatively, the present invention may be applied to other engines such as a diesel engine. In the above embodiments, the present invention is applied to the direct injection type gasoline engine, in which the injector is disposed at the center of the combustion chamber. Alternatively, the present invention may be applied to a direct injection type gasoline engine, in which an injector is mounted on a side of a cylinder, or a pre-mixing type gasoline engine, which injects the fuel into an intake pipe.

In the above embodiments, a single fixing member is used. Alternatively, the fixing member may be divided into multiple parts with respect to the axial direction, for instance.

The present invention should not be limited to the disclosed embodiments, but may be implemented in many other ways without departing from the spirit of the invention.

What is claimed is:

1. A mounting structure for mounting a fuel injection valve, which is formed with an injection hole in an end thereof and injects fuel through the injection hole, into a hole provided by a cylinder head of an internal combustion engine, the mounting structure comprising:

a fixing member formed with a fuel passage inside for supplying the fuel to the fuel injection valve, wherein the fixing member is accommodated in the hole at least partially and presses the fuel injection valve against the cylinder head in an axial direction;

a first connector, which protrudes radially outward from the fuel injection valve and is electrically connected with an electromagnetic drive portion of the fuel injection valve; and a second connector disposed radially outside the fixing member, wherein an end of the second connector is electrically connected with the first connector and the other end of the second connector is disposed outside the cylinder head.

2. The mounting structure as in claim 1, wherein the first connector is connected with the second connector by fitting the first connector with the second connector in the axial direction.

3. The mounting structure as in claim 1, wherein the fixing member has a small diameter portion, of which an external diameter is smaller than that of the other portion of the fixing member, and the second connector is fixed to the small diameter portion by a resin molding.

4. The mounting structure as in claim 1, further comprising:

a holding member fitted to a groove, which is formed on a circumference of an outer wall of the fixing member and is caved radially inward, for holding the second connector to the fixing member.

5. The mounting structure as in claim 1, wherein the mounting structure is formed so that the fixing member and the second connector are formed by a resin in a single piece.

6. The mounting structure as in claim 1, wherein the fixing member is formed integrally with a pipe member, which supplies the fuel to the fuel injection valve.

7. The mounting structure as in claim 1, wherein the second connector has a first terminal electrically connected with an exterior power source and a second terminal connected with the first connector, and the second connector is formed so that the first terminal and the second terminal are disposed separately from each other in the axial direction.

8. The mounting structure as in claim 1, wherein the second connector extends along the axial direction.

9. The mounting structure as in claim 8, wherein the first connector is connected with the second connector by fitting the first connector with the second connector in the axial direction.

10. A fixing member for pressing a fuel injection valve, which is accommodated in a hole penetrating a cylinder head, against the cylinder head in an axial direction, the fixing member comprising:

a cylinder portion providing a fuel passage inside for supplying fuel to the fuel injection valve;

an opening portion formed in the cylinder portion, wherein a first connector, which protrudes radially outward from the fuel injection valve and is electrically connected with an electromagnetic drive portion of the fuel injection valve, penetrates the opening portion; and a second connector disposed radially outside the fuel passage, wherein the second connector can be electrically connected with the first connector.

11. The fixing member as in claim 10, wherein the first connector is connected with the second connector by fitting the first connector with the second connector in the axial direction.

12. The fixing member as in claim 10, wherein the cylinder portion has a small diameter portion formed on a circumference of an outer wall of the cylinder portion, and the second connector is fixed to the small diameter portion by a resin molding.

13. The fixing member as in claim 10, further comprising:

a holding member fitted to a groove, which is formed on a circumference of an outer wall of the cylinder portion and is caved radially inward, for holding the second connector to the cylinder portion.

14. The fixing member as in claim 10, wherein the fixing member is formed so that the cylinder portion and the second connector are formed by a resin in a single piece.

15. The fixing member as in claim 10, wherein the fixing member is formed integrally with a pipe member, which supplies the fuel to the fuel injection valve.

16. The fixing member as in claim 10, wherein the second connector includes a first terminal connected with an exterior power source and a second terminal connected with the first connector, and the second connector is formed so that the first terminal and the second terminal are disposed separately from each other in the axial direction.

17. The fixing member as in claim 10, wherein the second connector extends along the axial direction.

18. The fixing member as in claim 17, wherein the first connector is connected with the second connector by fitting the first connector with the second connector in the axial direction.

* * * * *